United States Patent [19]

Nakamura et al.

[11] 4,278,063

[45] Jul. 14, 1981

[54] INTERNAL COMBUSTION ENGINE WITH AN EXHAUST GAS PURIFYING SYSTEM

[75] Inventors: Ken Nakamura, Kawasaki; Kunihiko Sugihara, Takasho; Shizuo Ishizawa, Yokosuka, all of Japan

[73] Assignee: Nissan Motor Company, Limited, Japan

[21] Appl. No.: 80,222

[22] Filed: Oct. 1, 1979

[30] Foreign Application Priority Data

Oct. 31, 1978 [JP] Japan ..... 53-148892[U]

[51] Int. Cl.[3] ..... F02B 47/08

[52] U.S. Cl. ..... 123/568; 123/571; 123/585; 123/587; 123/432

[58] Field of Search ..... 123/568, 571, 570, 589, 123/585, 587, 569, 588, 432

[56] References Cited

U.S. PATENT DOCUMENTS

| | | | |
|---|---|---|---|
| Re. 27,993 | 4/1974 | Walker | 123/568 |
| 2,316,618 | 4/1943 | Pyatt | 123/432 |
| 3,446,196 | 5/1969 | Daigh | 123/568 |
| 3,513,816 | 5/1970 | Daigh | 123/568 |
| 3,796,049 | 3/1974 | Hayashi | 123/587 |
| 3,859,971 | 1/1975 | Rauen | 123/432 |
| 3,977,188 | 8/1976 | Arnaud | 123/432 |
| 4,117,813 | 10/1978 | Yamashita et al. | 123/568 |
| 4,119,071 | 10/1978 | Hattori | 123/568 |
| 4,128,089 | 12/1978 | Takimoto et al. | 123/568 |

*Primary Examiner*—Wendell E. Burns

*Attorney, Agent, or Firm*—Lane, Aitken, Ziems, Kice & Kananen

[57] ABSTRACT

An exhaust gas purifying system for an internal combustion engine including at least one combustion chamber connected to an intake port through an intake valve. The system comprises a first passage for passing a portion of exhaust gases discharged from the combustion chamber, a second passage for passing air, a fluid passage, at least one fluid injection nozzle having its one end connected to the fluid passage and the other end extending into the intake port toward the combustion chamber, the fluid injection nozzle adapted to open when the intake valve opens, and means responsive to engine operating condition for connecting the fluid passage to the first passage to permit injection of exhaust gases through the fluid injection nozzle into the combustion chamber during acceleration and for connecting the fluid passage to the second passage to permit injection of air through the fluid injection nozzle into the combustion chamber during normal operation or idling.

14 Claims, 7 Drawing Figures

INTERNAL COMBUSTION ENGINE WITH AN EXHAUST GAS PURIFYING SYSTEM

BACKGROUND OF THE INVENTION

1. Field of the Invention

This invention relates to an exhaust gas purifying system for use in an internal combustion engine.

2. Description of the Prior Art

Exhaust gas recirculation systems have already been proposed which are designed to re-introduce a small amount of exhaust gases into the combustion cycle in order to reduce the generation of nitrous oxide. However, any attempt to increase the amount of exhaust gas re-introduced so as to reduce nitrous oxides or to rarefy the air-fuel mixture supplied to the engine so as to reduce nitrous oxides, hydrocarbons and carbon monoxide will result in poor drivability. Additionally, any attempt to enrich the air-fuel mixture supplied to the engine so as to maintain adequate drivability will result in increased hydrocarbons and carbon monoxide.

FIG. 1 is a graph showing the exhaust characteristics of prior art internal combustion engines. It is realized in FIG. 1 that nitrous oxides increase during acceleration. Thus, it is common practice to determine the amount of exhaust gases re-introduced on the basis of the condition appearing during acceleration. However, this causes an excessive amount of exhaust gases to be re-introduced during normal operation, which results in a drivability penalty.

SUMMARY OF THE INVENTION

It is therefore one object of the present invention to improve the pollutant characteristics of an internal combustion engine over a wide range of engine operating conditions.

Another object of the present invention is to provide an exhaust gas purifying system which permits an internal combustion engine to operate with proper fuel combustion.

Still another object of the present invention is to provide an exhaust gas purifying system which permits an internal combustion engine to operate with high fuel economy, drivability and pollutant characteristics.

According to the present invention, these and other objects are accomplished by an exhaust gas purifying system for use in an internal combustion engine including at least one combustion chamber connected to an intake port through an intake valve, the system comprising a first passage for passing a portion of exhaust gases discharged from the combustion chamber, a second passage for passing air, a fluid passage at least one fluid injection nozzle having its one end connected to the fluid passage and the other end extending into the intake port toward the combustion chamber, the fluid injection nozzle adapted to open when the intake valve opens, and means responsive to engine operating conditions for connecting the fluid passage to the first passage to permit injection of exhaust gases through the fluid injection nozzle into the combustion chamber during acceleration and for connecting the fluid passage to the second passage to permit injection of air through the fluid injection nozzle into the combustion chamber during normal operation or idling.

Other objects, means, and advantages of the present invention will become apparent to one skilled in the art thereof from the following description.

BRIEF DESCRIPTION OF THE DRAWINGS

The following explanation of several preferred embodiments of the present invention will help in the understanding thereof, when taken in conjunction with the accompanying drawings, which, however, should not be taken as limiting the present invention in any way, but which are given for purposes of illustration only. In the drawings, like parts are denoted by like reference numerals in the several figures, and.

DESCRIPTION OF THE PREFERRED EMBODIMENTS

Figure 1:
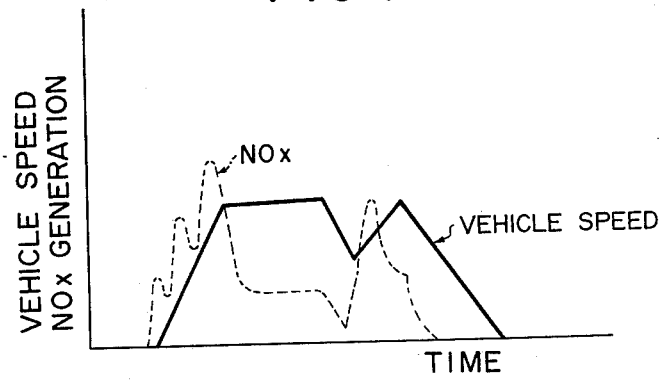
FIG. 1 is a graph showing the exhaust characteristics provided by prior art internal combustion engines relative to vehicle speed over a period of time.
Figure 2:
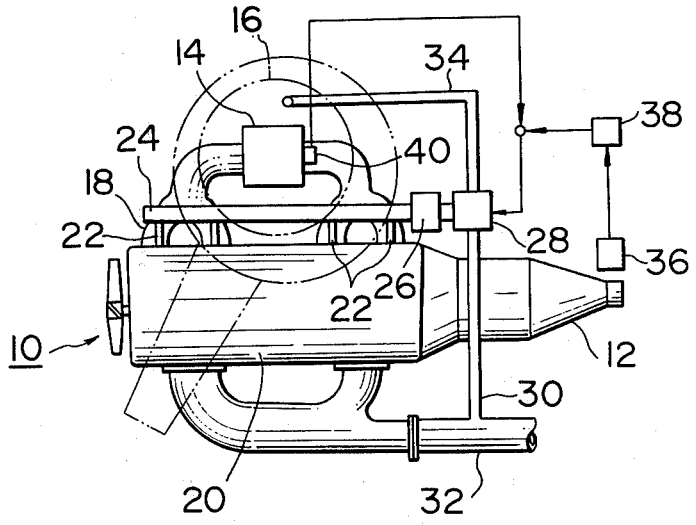
FIG. 2 is a schematic view showing an internal combustion engine and exhaust gas purifying system including the present invention.

FIG. 2 illustrates the principles of the present invention as applied to an internal combustion engine 10 associated with a power transmission 12 and equipped with a carburetor 14. The carburetor 14 is connected at its one end through an air cleaner 16 to atmospheric air and at the other end through an intake manifold 18 to the engine body 20 of the engine 10. Extending into the engine body 20, separately from the intake manifold 18, are fluid injection nozzles 22 which have their one ends connected through a fluid passsage 24. The fluid passage 24 is connected through a fluid flow control device 26 to a fluid selector 28. The fluid selector 28 is connected through an exhaust gas introduction passage 30 to the exhaust passage 32 of the engine 10 and also through an air introduction passage 34 and the air cleaner 16 to atmospheric air.

A first sensor 36 is provided for discriminating two engine operating conditions, namely, acceleration and normal operation. The first sensor 36 may be a switch associated with the power transmission 12 and adapted to close during normal operation when the power transmission 12 is in its top gear position and to open during acceleration when the power transmission is in its lower gear positions. If acceleration is continuously made for a predetermined time, a first control signal is applied through a delay device 38 to the fluid selector 28. The fluid selector 28 is responsive to the first control signal for connecting the fluid passage 24 to the exhaust gas introduction passage 30 so as to permit injection of exhaust gases through the fluid injection nozzles 22. The fluid flow control device 26 is responsive to engine manifold vacuum (engine operating conditions) for controlling the amount of exhaust gases injected. During normal operation, the fluid selector 28 connects the fluid passage 24 to the air introduction passage 34 so as to permit injection of air through the fluid injection nozzles 22 and the fluid flow control device 26 controls the amount of air injected.

A second sensor 40 is provided for discriminating whether or not the engine is idling. The second sensor 40 may be a switch associated with the throttle valve of the carburetor 14 and adapted to close when the throttle valve is in its idling positions so as to provide a second control signal to the fluid selector 28. The fluid selector 28 is responsive to the second control signal for connecting the fluid passage 24 to the air introduction passage 34 so as to permit injection of air through the fluid injection nozzles. The fluid flow control device 26 is responsive to engine manifold vacuum for controlling the amount of air injected.

Accordingly, during acceleration causing increased oxides of nitrogen, exhaust gases is injected into the combustion chambers. This suppresses the generation of nitrous oxides and produces turbulance within the combustion chambers to provide proper fuel combustion. During idling or normal operation, air is injected into the combustion chambers to produce turbulance within the combustion chambers thereby providing proper fuel combustion. Thus, it is possible to purify exhaust emissions and improve fuel economy and drivability over a wide range of engine operating conditions.

Figure 3:
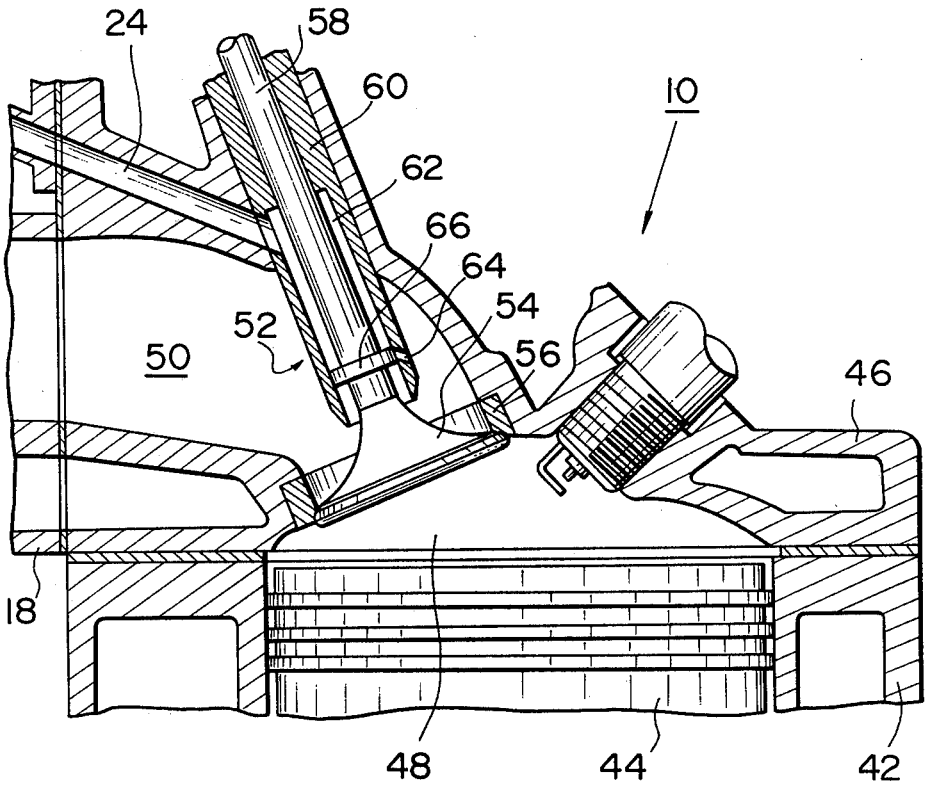
FIG. 3 is a fragmentary enlarged sectional view showing the structure of the fluid injection nozzle used in the exhaust gas purifying system of FIG. 2.

Referring to FIG. 3, the engine 10 comprises a cylinder block 42 having at least one cylinder bore therein reciprocably mounting a piston 44. A cylinder head 46 is mounted on and sealed with respect to the cylinder block 42 to close the upper end of the cylinder bore so as to form therewith an expandable combustion chamber 48. The cylinder head 46 is provided with an intake port 50 opening into the combustion chamber 48. An intake valve 52 is provided for controlling the passage of fuel and air from the intake port 50 to the combustion chamber 48.

The intake valve 52 includes a valve element 54 adapted to seat against a valve seat insert 56 mounted in the port opening, and a stem 58 reciprocally mounted in a valve guide 60. The valve guide 60 has a large diameter bore to define an annular passage 62 together with the stem 58. The annular passage is connected to the fluid passage 24. The valve guide 60 is formed with a channel 64 having its one end connected to the annular passage 64 and the other end opening into the intake port 50 toward the clearance produced between the valve element 54 and the valve seat insert 56 when the intake valve 52 is opened. A collar 66 is mounted on the stem 58 such as to normally disconnect the channel 64 from the annular passage 64 and to connect the channel 64 to the annular passage 64 during the intake stroke of the piston 44 when the intake valve 52 opens. Since the channel 64 is disconnected from the annular passage 64 by the collar 66 simultaneously when the intake valve 52 is closed, there is no possibility of exhaust gases (or air) entering the intake port 50.

Figure 4:
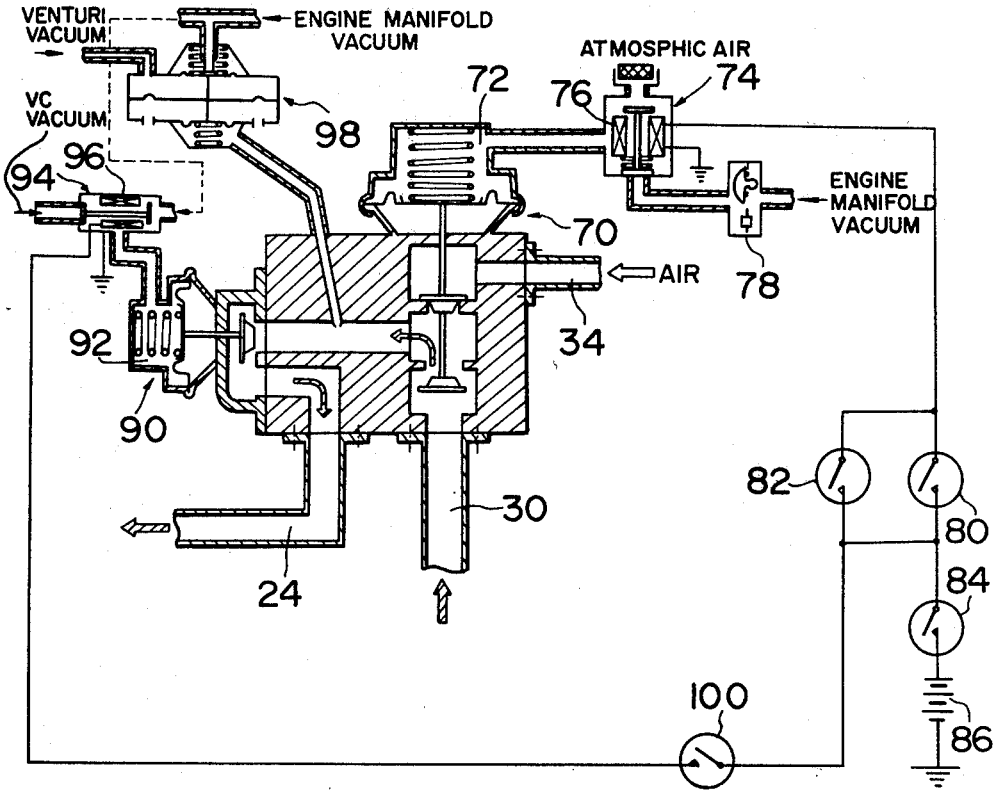
FIG. 4 is a sectional view showing one embodiment of the present invention.

Referring to FIG. 4, the fluid selector 28 is shown as comprising a pressure-operated change-over valve 70 having a pressure chamber 72, and a first electromagnetic valve 74 having a drive coil 76. The electromagnetic valve 74 permits air to enter the pressure chamber 72, causing the change-over valve 70 to connect the fluid passage 24 to the exhaust gas introduction passage 30 when the drive coil 76 is deenergized, whereas it permits introduction of intake manifold vacuum through a delay valve 78, causing the change-over valve 70 to connect the fluid passage 24 to the air introduction passage 34 when the drive coil 76 is energized. The drive coil 76 is coupled through a first switch 80 connected in parallel with a second switch 82 and in series with an ignition switch 84 to a battery 86. The first switch 80 is associated with the power transmission 12 and adapted to close when the power transmission 12 is in its top gear position and to open when the power transmission 12 is in its lower gear positions. The second switch 82 is associated with the throttle valve of the carburetor 14 and adapted to close when the throttle valve is in its idling positions.

The fluid flow control device 26 comprises a vacuum-operated flow control valve 90 having a vacuum chamber 92 changed with vacuum for controlling the flow of fluid passing through the fluid passage 24 in accordance with engine operating conditions, a second electromagnetic valve 94 having a drive coil 96, and a vacuum controlling device 98. The second electromagnetic valve 94 permits introduction of intake manifold vacuum into the vacuum chamber 92 of the flow control valve 90 when the drive coil 96 is deenergized and also permits introduction of VC vacuum into the vacuum chamber 92 when the drive coil 96 is energized. The drive coil 96 is coupled to the battery 86 through a third switch 100 similar in operation to the second switch 82. The vacuum control device 98 is responsive to venturi vacuum and the pressure appearing in the fluid passage 24 upstream of the flow control valve 90 for controlling the intake manifold vacuum introduced through the second electromagnetic valve 94 into the vacuum chamber 92 of the flow control valve 90.

During acceleration when both of the first, second and third switches 80, 82 and 100 are open, the first electromagnetic valve 74 is held deenergized and air enters the pressure chamber 72 of the change-over valve 70 so that exhaust gases are introduced from the exhaust gas introduction passage 30 into the fluid passage 24 and injected through the fluid injection nozzle 22 into the combustion chamber 48. The second electromagnetic valve 94 is held deenergized and intake manifold vacuum is charged into the vacuum chamber 92. Thus, the amount of exhaust gases injected through the fluid injection nozzle 22 is controlled in accordance with the engine manifold vacuum which is controlled in accordance with venturi vacuum and the pressure of the exhaust gases flowing through the fluid passsage 24.

During normal operation, the first switch 80 is turned on. Thus, the first electromagnetic valve 74 is energized to permit introduction of engine manifold vacuum into the pressure chamber 72 so that air is introduced from the air introduction passage 34 into the fluid passage 24 and injected through the fluid injection nozzle 22 into the combustion chamber 48. The delay valve 78 serves to accomplish gradual intake manifold vacuum introduction after the first electromagnetic valve 74 is energized. The second electromagnetic valve 94 is held deenergized and intake manifold vacuum is charged through the second electromagnetic valve 94 into the vacuum chamber 92 of the fluid flow control valve 90. Thus, the amount of air injected through the fluid injection nozzle 22 is controlled in accordance with the engine manifold vacuum which is controlled in accordance with venturi vacuum and the pressure of the air flowing through the fluid passage 24.

While the engine is idling, the second and third switches 82 and 100 are turned on. The first electromagnetic valve 74 is energized to permit introduction of intake manifold vacuum into the pressure chamber 72 so that air is introduced from the air introduction passage 34 into the fluid passage 24 and injected through the fluid injection nozzle 22 into the combustion chamber 48. In this case, the second electromagnetic valve 94 is energized to permit introduction of VC vacuum into the vacuum chamber 92 of the flow control valve 90. Thus, the amount of air injected through the fluid injection nozzle 22 is controlled to an optimum level for idle.

Although the first sensor 36 has been described as a switch 80 associated with the power transmission 12 and adapted to close when the power transmission 12 is in its top gear position, it is to be noted that it may be a throttle valve switch, or a vacuum-operated switch responsive to variations in engine manifold vacuum for discriminating acceleration and normal operation. In addition, the second sensor 40 may be in the form of a transmission neutral switch, vehicle speed switch, or engine speed switch.

Figure 5:
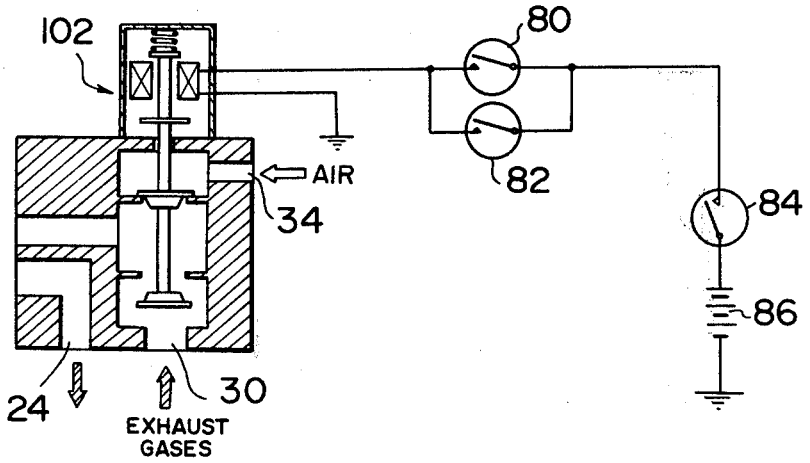
FIG. 5 is a sectional view showing a second embodiment of the present invention.

Referring to FIG. 5, there is illustrated a second embodiment of the present invention. This embodiment is substantially similar to the first embodiment except that the pressure-operated change-over valve 70 and the first electromagnetic valve 74 are eliminated and replaced with an electromagnetic change-over valve 102. The change-over valve 102 has a drive coil coupled to the battery 86 through the first switch 80 connected in parallel with the second switch 82 and in series with the ignition switch 86. The electromagnetic change-over valve 102 connects the fluid passage 24 to the exhaust gas introduction passage when deenergized, whereas it connects the fluid passage 24 to the air introduction passage 34 when energized.

Figure 6:
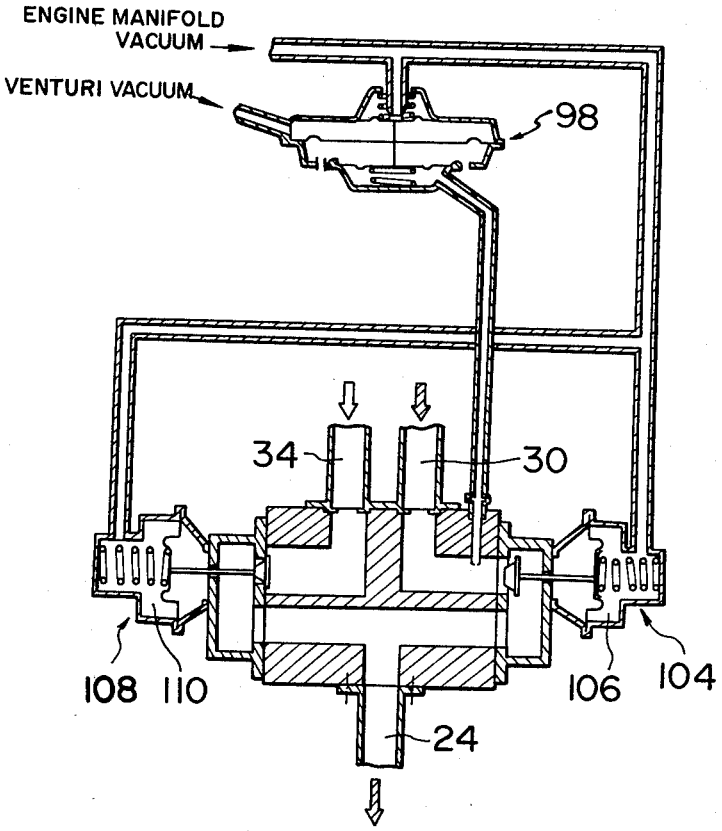
FIG. 6 is a sectional view showing a third embodiment of the present invention.
Figure 7:
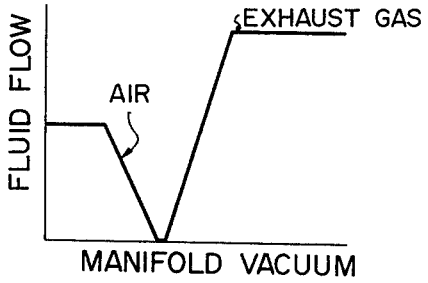
FIG. 7 is a graph showing the control characteristics provided by the exhaust gas purifying system of FIG. 6.

Referring to FIG. 6, there is illustrated a third embodiment of the present invention. In this embodiment, a vacuum-operated exhaust gas flow control valve 104 is interposed between the fluid passage 24 and the exhaust gas introduction passage 30 and a vacuum-operated air flow control valve 108 is interposed between the fluid passage 24 and the air introduction passage 34. The exhaust gas flow control valve 104 is responsive to intake manifold vacuum charged in its vacuum chamber 106 for increasing its valve opening with an increase in intake manifold vacuum. The air flow control valve 108 is responsive to intake manifold vacuum charged in its vacuum chamber 110 for decreasing its valve opening with an increase in intake manifold vacuum. The vacuum control device 98 is responsive to venturi vacuum and exhaust gas pressure for controlling the level of intake manifold vacuum introduced into the vacuum chambers 106 and 110 for feedback control of the amount of fluid injected through the fluid injection nozzle 22. In this embodiment, injected through the fluid injection nozzle 22 into the combustion chamber 48 is air when the intake manifold vacuum is below a predetermined level and exhaust gases when the intake manifold vacuum is above the predetermined level as shown in FIG. 7.

It is preferable to inject air-fuel mixture through the fluid injection nozzle 22 into the combustion chamber 48 while the engine is idling. This eliminates the need for any air-fuel mixture supplied from the carburetor into the combustion chamber, which results in a simplified carburetor and stabilized engine operation.

The above described exhaust gas purifying system injects exhaust gases into the combustion chamber to suppress the generation of nitrous oxides and produce turbulance within the combustion chamber so as to fully mix fuel and air charged therein during acceleration causing increased oxides of nitrogen and injects air into the combustion chamber to produce turbulance within the combustion chamber so as to fully mix fuel and air charged therein during idling or normal operation. Thus, it is possible to purify exhaust emissions and provide proper fuel combustion resulting in high fuel economy and drivability over a wide range of engine operating conditions.

What is claimed is:

1. An exhaust gas purifying system for use in an internal combustion engine including at least one combustion chamber connected to an intake port through an intake valve, comprising:

(a) a first passage for passing a portion of exhaust gases discharged from said combustion chamber;
(b) a second passage for passing air;
(c) a fluid passage;
(d) at least one fluid injection nozzle having its one end connected to said fluid passage and the other end extending into said intake port toward said combustion chamber, said fluid injection nozzle adapted to open when said intake valve opens; and
(e) means responsive to engine operating condition for connecting said fluid passage to said first passage to permit injection of exhaust gases through said fluid injection nozzle into said combustion chamber during acceleration and for connecting said fluid passage to said second passage to permit injection of air through said fluid injection nozzle into said combustion chamber during normal operation or idling.

2. An exhaust gas purifying system according to claim 1, wherein said means comprises an electromagnetic change-over valve for connecting said fluid passage to said first passage when deenergized and to said second passage when energized, first switch means adapted to close to couple a voltage to said electromagnetic change-over valve during normal operation, and second switch means adapted to close to couple a voltage to said electromagnetic change-over valve during idling.

3. An exhaust gas purifying system according to claim 2, wherein said first switch means is in the form of a switch associated with the power transmission of said engine and adapted to close when said power transmission is in its top gear position.

4. An exhaust gas purifying system according to claim 2, wherein said second switch means is in the form of a switch associated with the throttle valve of the carburetor of said engine and adapted to close when said throttle valve is in its idling positions.

5. An exhaust gas purifying system according to claim 1, wherein said means comprises a pressure-operated change-over valve having a pressure chamber for connecting said fluid passage to said first passage when said pressure chamber is charged with air and to said second passage when said pressure chamber is charged with engine manifold vacuum, an electromagnetic change-over valve allowing introduction of air to said pressure chamber when deenergized and allowing introduction of engine manifold vacuum to said pressure chamber when energized, first switch means adapted to close to couple a voltage to said electromagnetic change-over valve during normal operation, and second switch means adapted to close to couple a voltage to said electromagnetic change-over valve during idling.

6. An exhaust gas purifying system according to claim 5, which further comprises a delay valve interposed between said electromagnetic change-over valve and the intake manifold of said engine for accomplishing gradual intake manifold vacuum introduction after said electromagnetic change-over valve is energized.

7. An exhaust gas purifying system according to claim 5, wherein said first switch means is in the form of a switch associated with the power transmission of said engine and adapted to close when said power transmission is in its top gear position.

8. An exhaust gas purifying system according to claim 5, wherein said second switch means is in the form of a switch associated with the throttle valve of the carburetor of said engine and adapted to close when said throttle valve is in its idling positions.

9. An exhaust gas purifying system according to claim 1, wherein said means comprises a first vacuum-operated valve interposed between said fluid passage and said first passage and having a vacuum chamber charged with engine manifold vacuum, said first vacuum-operated valve adapted to increase its opening with an increase in engine manifold vacuum, a second vacuum-operated valve interposed between said fluid passage and said second passage and having a vacuum chamber charged with engine manifold vacuum, and said second vacuum-operated valve adapted to decrease its opening with an increase in engine manifold vacuum.

10. An exhaust gas purifying system according to claim 9, which further comprises a vacuum control valve responsive to venturi vacuum and the pressure appearing in said first passage for controlling the level of engine manifold vacuum charged in said vacuum chambers according thereto.

11. An exhaust gas purifying system according to claim 1, which further comprises a fluid flow control device provided in said fluid passage for controlling the amount of fluid passing through said fluid passage in accordance with engine operating condition.

12. An exhaust gas purifying system according to claim 11, wherein said fluid flow control device comprises a vacuum-operated fluid flow control valve having a vacuum chamber, an electromagnetic change-over valve for allowing introduction of engine manifold vacuum into said vacuum chamber when deenergized and allowing introduction of VC vacuum into said vacuum chamber when energized, switch means adapted to close to couple a voltage to said electromagnetic change-over valve during idling, and a vacuum control device responsive to venturi vacuum and the pressure appearing in said fluid passage upstream of said fluid flow control valve for controlling the level of engine manifold vacuum charged through said electromagnetic change-over valve into said vacuum chamber of said fluid flow control valve.

13. An exhaust gas purifying system according to claim 12, wherein said switch means is in the form of a switch associated with the throttle valve of the carburetor of said engine and adapted to close when said throttle valve is in its idling positions.

14. An exhaust gas purifying system according to claim 1, wherein said intake valve includes a valve seat insert mounted in the opening of said intake port, a valve element adapted to seat against said valve seat insert, a valve guide, a stem reciprocally mounted in said valve guide, said valve guide having a large diameter bore to define an injection passage together with said stem, said injection passage connected to said fluid passage, said valve guide formed with a channel having its one end connected to said injection passage and the other end opening into said intake port toward the clearance produced between said valve element and said valve seat insert when said intake valve is opened, and a collar mounted on said stem for normally closing said channel and opening said channel when said intake valve is opened.

* * * * *